US007616086B2

(12) United States Patent
Kweon et al.

(10) Patent No.: US 7,616,086 B2
(45) Date of Patent: Nov. 10, 2009

(54) INTEGRATED TYPE TRANSFORMER

(75) Inventors: Gie Hyoun Kweon, Gyunggi-do (KR); Sug Chin Sakong, Seoul (KR); Chung Wook Roh, Seoul (KR); Sang Kyoo Han, Daejeon (KR); Sung Soo Hong, Seoul (KR); Jong Rak Kim, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 11/964,521

(22) Filed: Dec. 26, 2007

(65) Prior Publication Data

US 2008/0231404 A1 Sep. 25, 2008

(30) Foreign Application Priority Data

Mar. 21, 2007 (KR) ..... 10-2007-0027562

(51) Int. Cl.
*H01F 27/30* (2006.01)

(52) U.S. Cl. ..... 336/208

(58) Field of Classification Search ..... 336/212, 336/208, 198, 192

See application file for complete search history.

(56) References Cited

U.S. PATENT DOCUMENTS

| | | | | |
|---|---|---|---|---|
| 6,154,113 | A * | 11/2000 | Murai | 336/208 |
| 6,414,583 | B1 * | 7/2002 | Yeh et al. | 336/200 |
| 7,176,777 | B2 * | 2/2007 | Hsueh et al. | 336/208 |
| 7,274,282 | B2 | 9/2007 | Park et al. | |
| 2007/0030109 | A1 * | 2/2007 | Kohno | 336/208 |
| 2007/0046414 | A1 * | 3/2007 | Wu | 336/208 |
| 2007/0216511 | A1 * | 9/2007 | Tseng et al. | 336/208 |
| 2007/0241853 | A1 * | 10/2007 | Yang et al. | 336/208 |
| 2007/0257760 | A1 | 11/2007 | Saito et al. | |

FOREIGN PATENT DOCUMENTS

| | | | |
|---|---|---|---|
| KR | 20-0299597 | Y1 | 12/2002 |
| KR | 10-2006-0134639 | A | 12/2006 |
| WO | 2006025156 | A1 | 9/2006 |

OTHER PUBLICATIONS

Korean Intellectual Property Office, Office Action mailed Jan. 4, 2008 and English Translation.

* cited by examiner

*Primary Examiner*—Elvin G Enad
*Assistant Examiner*—Joselito Baisa
(74) *Attorney, Agent, or Firm*—Lowe Hauptman Ham & Berner, LLP

(57) ABSTRACT

There is provided an integrated type transformer that reduces the volume by integrating a plurality of transformers transmitting power for driving a plurality of lamps in an inverter circuit for an LCD into one transformer structure. An integrated type transformer according to an aspect of the invention includes a bobbin unit including a bobbin body having a predetermined length and a through hole therein in a longitudinal direction of the bobbin unit, and a core unit including an inner core inserted into the through hole of the bobbin unit, and an outer core formed along one surface in the longitudinal direction among outer circumferential surfaces of the bobbin unit and electromagnetically coupled to the inner core to form one magnetic path.

8 Claims, 8 Drawing Sheets

(a)

(b)

(a)

(b)

(a)

(b)

(a)

(b)

INTEGRATED TYPE TRANSFORMER

CROSS-REFERENCE TO RELATED APPLICATIONS

This application claims the priority of Korean Patent Application No. 2007-27562 filed on Mar. 21, 2007, in the Korean Intellectual Property Office, the disclosure of which is incorporated herein by reference.

BACKGROUND OF THE INVENTION

1. Field of the Invention

The present invention relates to an integrated type transformer, and more particularly, to an integrated type transformer that reduces the volume by integrating a plurality of transformers transmitting power for driving a plurality of lamps in an inverter circuit for an LCD into one transformer structure.

2. Description of the Related Art

In recent years, liquid crystal display (LCD) products, such as LCD TVs or LCD monitors, have become larger. At the same time, however, there has been a need for a decrease in volume of the large LCD products. In order to satisfy the need, development has been carried out to realize small and compact built-in circuits and components that are used in the LCD products. This trend is also found in driving circuits, which are one of the main circuits in the LCD products.

The above-described LCD driving circuit generally uses a power conversion transformer to supply a current to a plurality of lamps. According to a general method of making the LCD driving circuit smaller, the volume of the transformer that supplies the current to the lamps is decreased.

FIG. 1A is a plan view illustrating a transformer according to the related art.

Referring to FIG. 1A, the transformer according to the related art includes a bobbin B that has a plurality of winding sections, and a core Co that is electromagnetically coupled to the bobbin B.

A primary coil C1 is wound around the center winding section. Secondary coils C2 are separately wound around both winding sections around the center winding section. The core Co that is coupled to the bobbin B surrounds the inside of the bobbin B and the bobbin B in a longitudinal direction thereof to form two magnetic paths, which will be described in detail with reference to FIG. 1B.

FIG. 1B is a cross-sectional view illustrating the transformer taken along the line a-a' according to the related art.

Referring to FIG. 1B, the core Co that is coupled to the bobbin B includes an inner core Coi that is inserted into the inside Bi of the bobbin, and outer cores Coo1 and Coo2 that are formed along two surfaces that face each other among outer circumferential surfaces of the bobbin B. The inner core Coi is electromagnetically coupled to the external cores Coo1 and Coo2 to form magnetic paths, that is, two magnetic paths. The current that flows into the primary coil C1 is converted into AC power, which is set beforehand, and then transmitted to the lamps (not shown) by the secondary coils C2.

In the transformer according to the related art, a plurality of transformers are integrated into one transformer structure. However, since the volume of the transformer is still large, it is difficult to manufacture a small, thin, lightweight driving circuit that uses the transformer.

SUMMARY OF THE INVENTION

An aspect of the present invention provides an integrated type transformer that reduces the volume by integrating a plurality of transformers transmitting power for driving a plurality of lamps in an inverter circuit for an LCD into one transformer structure.

According to an aspect of the present invention, there is provided an integrated type transformer including: bobbin unit including a bobbin body having a predetermined length and a through hole therein in a longitudinal direction of the bobbin unit; and a core unit including an inner core inserted into the through hole of the bobbin unit, and an outer core formed along one surface in the longitudinal direction among outer circumferential surfaces of the bobbin unit and electromagnetically coupled to the inner core to form one magnetic path.

The integrated type transformer may further include a coil unit including a primary coil wound around the outer circumferential surfaces of the bobbin unit and a plurality of secondary coils electromagnetically coupled to the primary coil; and a terminal unit including an input terminal transmitting input power to the primary coil and an output terminal transmitting output power from the secondary coils.

The output terminal of the terminal unit may be formed at the one surface of the bobbin unit at which the outer core is formed.

The inner core may be an I-shaped core having one end and the other end, and the outer core may be a C-shaped core having a support part formed along one surface of the bobbin unit and protrusion parts formed at one end and the other end of the support part along the same direction and electromagnetically coupled to the one end and the other end of the I-shaped core.

The core unit may include two open square-shaped cores each including: a support part having one end and the other end; an inner protrusion part formed at the one side of the support part and inserted into the through hole of the bobbin unit; and an outer protrusion part formed at the other side of the support part, formed along the same direction as a direction of the inner protrusion part, and formed along one surface of the bobbin unit, and the two open square-shaped cores may face each other and be electromagnetically coupled to each other, such that the inner protrusion parts of the two cores may form the inner core, and the outer protrusion parts and the support parts thereof may form the outer core. Further, the thickness of the inner protrusion part may be smaller than that of the outer protrusion part.

The primary coil may be wound around the center of the outer circumferential surfaces of the bobbin unit, and the plurality of secondary coils may be wound around both sides of the circumferential surfaces around the primary coil along the longitudinal direction of the bobbin unit.

A cross walk may be formed at the center of the outer circumferential surfaces of the bobbin unit to equally divide the winding number of the primary coil.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 2:
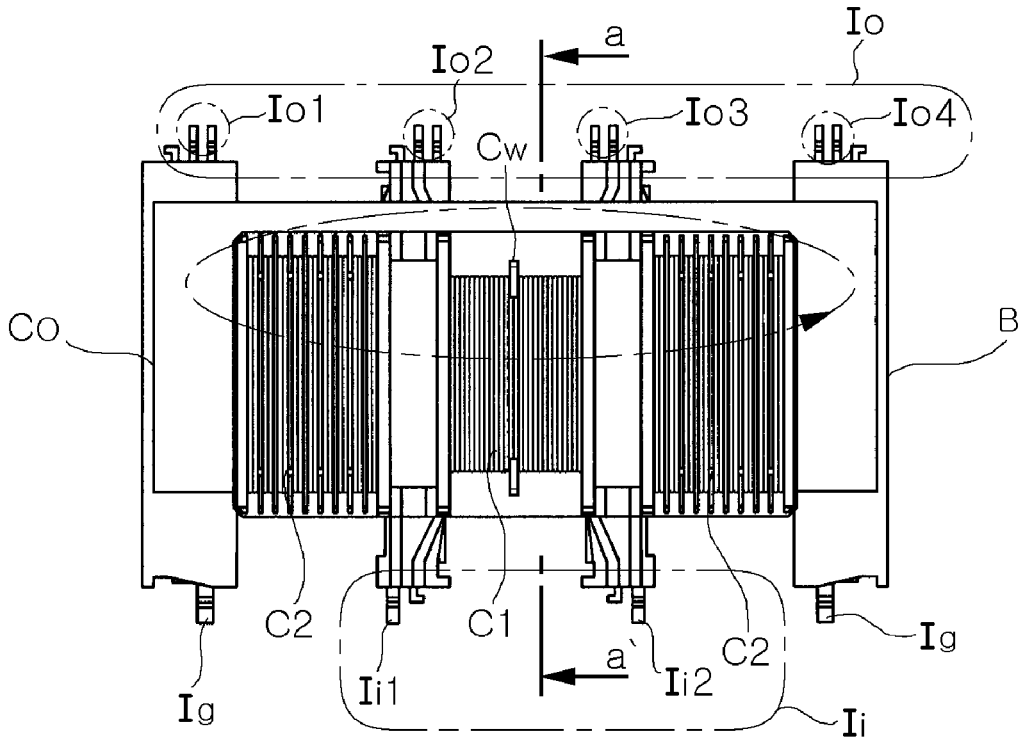
FIG. 2A is a plan view illustrating a transformer according to an exemplary embodiment of the present invention.
FIG. 2B is a cross-sectional view taken along the line a-a' of the transformer according to the exemplary embodiment of the present invention.
Figure 2:
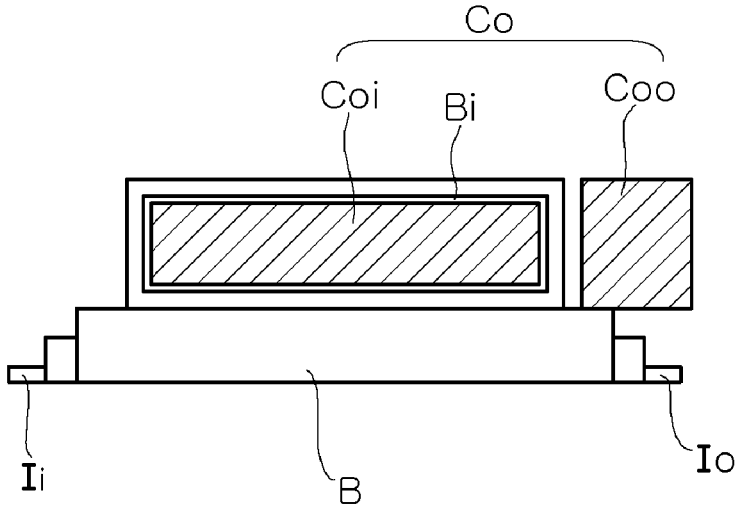

FIG. 2A is a plan view illustrating a transformer according to an exemplary embodiment of the present invention. FIG. 2B is a cross-sectional view taken along the line a-a' of the transformer shown in FIG. 2A.

Referring to FIGS. 2A and 2B, the transformer according to the exemplary embodiment of the present invention includes a bobbin unit B, a core unit Co that is coupled to the bobbin unit B, coil units C1 and C2 that are wound around the bobbin unit B, and terminal units Ii and Io that are formed on the bobbin unit B.

The bobbin unit B has a predetermined length and a through hole Bi formed therein.

The core unit Co includes an inner core Coi and an outer core Coo. The inner core Coi is inserted into the through hole Bi of the bobbin unit B. The outer core Coo is formed along one surface of the bobbin unit B that is formed in a longitudinal direction of the bobbin unit B. The inner core Coi and the outer core Coo are electromagnetically coupled to each other to form a magnetic path that is a path of magnetic flux. Here, one inner core Coi and one outer core Coo are electromagnetically coupled to each other to form one magnetic path.

The coil units C1 and C2 are wound around outer circumferential surfaces of the bobbin unit B. The coil units C1 and C2 include a primary coil C1 and a plurality of secondary coils C2. The primary coil C1 is wound around the center of the outer circumferential surfaces of the bobbin unit B. The plurality of secondary coils C2 are wound around both sides of the outer circumferential surfaces, respectively, around the primary coil C1 along the longitudinal direction of the bobbin unit B. The primary coil C1 corresponds to the secondary coil C2 to form one electric transformer. When the secondary coils C2 are wound around both sides of the outer circumferential surfaces of the bobbin unit B, respectively, two transformers may be integrated into one transformer structure. When two of each of the secondary coils C2 are wound, four electrical transformers may be integrated into one transformer structure.

The terminal units Ii and Io include an input terminal Ii and an output terminal Io. The terminal units Ii and Io may further include a fixing or grounding terminal Ig. The input terminal Ii and the output terminal Io are formed at one surface and the other surface of the bobbin unit B, respectively, which are located opposite to each other. The input terminal Ii transmits input power to the primary coil C1, a first input terminal Ii1 is connected to one end of the primary coil C1, and a second input terminal Ii2 is connected to the other end of the primary coil C1. The output terminal Io transmits to the outside, output power that is set according to a winding ratio between the primary coil C1 and the secondary coils C2. Then, a first output terminal Io1 of the output terminal Io is connected to one end of the one secondary coil C2 that is wound around the outer circumferential surfaces of the one side of the bobbin unit B, and a second output terminal Io2 is connected to the other end of the secondary coil C2 that is wound around the outer circumferential surfaces of the one side of the bobbin unit B. In the same manner, a third output terminal Io3 is connected to one end of the other secondary coil C2 that is wound around the outer circumferential surfaces of the other side of the bobbin unit B, and a fourth output terminal Io4 is connected to the other end of the secondary coil C2 that is wound around the outer circumferential surfaces of the other side of the bobbin unit B.

Preferably, the output terminal Io and the outer core Coo may be formed on the same outer circumferential surface of the bobbin unit B. As shown below in Table 1, experiments show that an output current deviation can be reduced by an electromagnetic action between the input and output terminals Ii and Io, the core unit Co, and the coil units C1 and C2 when the output terminal Io and the outer core Coo are formed at the same outer circumferential surface.

TABLE 1

| | Same | Different |
|---|---|---|
| Lamp 1 tube current | 8.2 mA | 6.9 mA |
| Lamp 2 tube current | 7.9 mA | 8.5 mA |
| Lamp 3 tube current | 7.9 mA | 8.0 mA |
| Lamp 4 tube current | 8.0 mA | 6.7 mA |

Referring to Table 1, when the output terminal Io and the outer core Coo are formed at the same outer circumferential surface of the same bobbin unit B, a tube current deviation between the lamps is 0.3 mA. On the other hand, when the output terminal Io and the outer core Coo are formed at the different outer circumferential surfaces of the bobbin unit B that are opposite to each other, the tube current deviation between the lamps is 1.8 mA.

In general, when a rated output current (lamp tube current) is 8 mA, an output current deviation that is required by a user is 0.5 mA. Therefore, preferably, the output terminal Io and the outer core Coo are formed at the same outer circumferential surface of the bobbin unit B.

Further, a cross walk Cw that equally divides the winding number of the primary coil C1 may be formed at the center of the outer circumferential surfaces around which the primary coil C1 of the bobbin unit B is wound. Taking into account the fact that the output power is determined according to the winding ratio between the primary coil C1 and the secondary coils C2, the output power of each of the secondary coils C2 can be equally controlled.

Figure 3A:
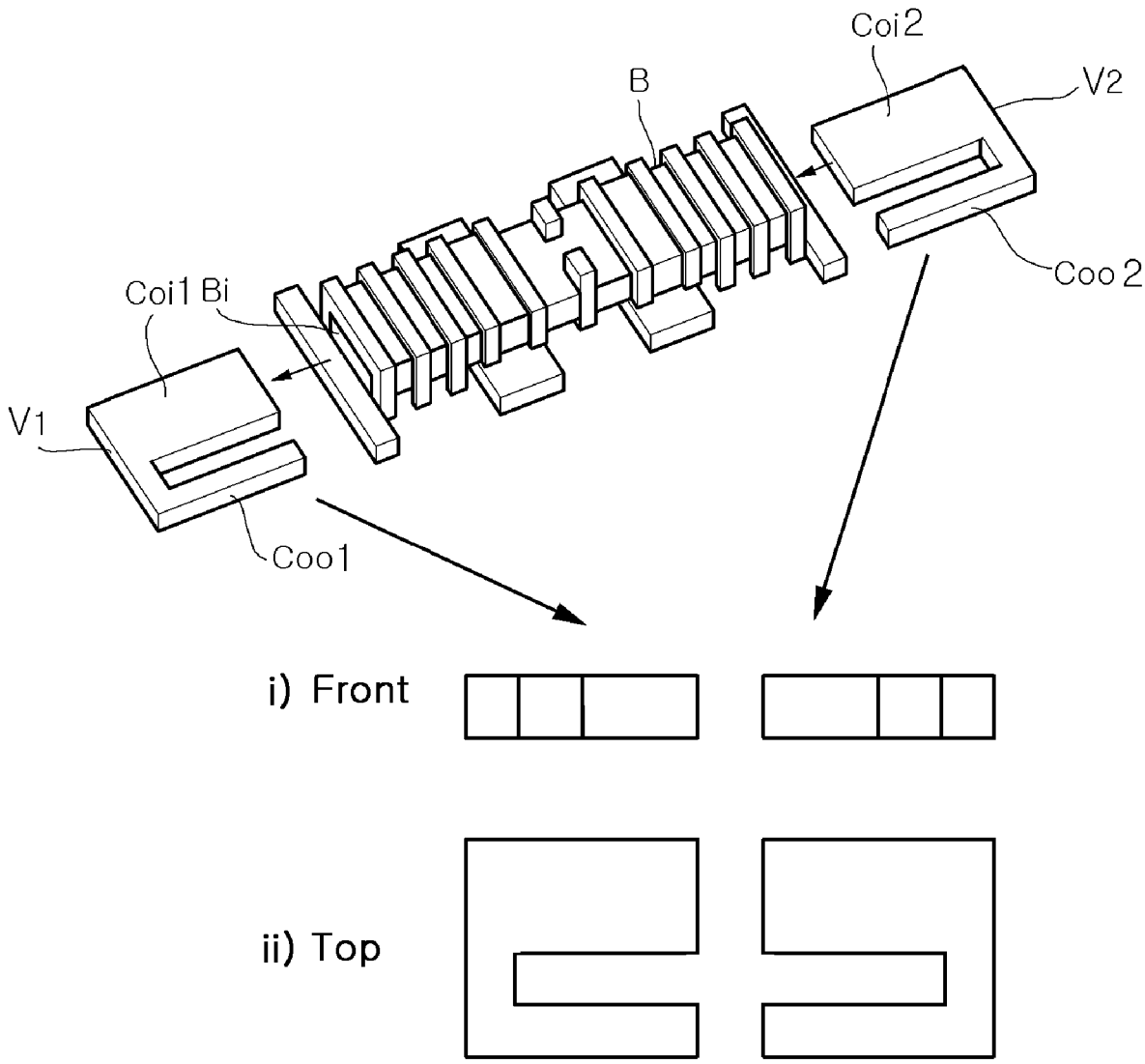
FIG. 3A is an exploded perspective view illustrating a transformer according to one exemplary embodiment of the present invention.

FIG. 3A is an exploded perspective view illustrating a transformer according to one exemplary embodiment of the present invention.

Referring to FIG. 3A, the one exemplary embodiment of the transformer according to the present invention relates to an exemplary embodiment of a core unit Co that is used in the transformer according to the invention.

The core unit Co includes two open square-shaped cores that are coupled to form one magnetic path. That is, a first open square-shaped core includes a first support part V1, a first inner protrusion part Coi1, and a first outer protrusion part Coo1. The first support part V1 has one side and the other side. The first inner protrusion part Coi1 is formed at the one side of the first support part V1 and inserted into a through hole Bi of a bobbin unit B. The first outer protrusion part Coo1 is formed at the other side of the first support part V1 along the same direction as a direction of the first inner protrusion part Coi1, and formed along one surface formed in the longitudinal direction of the bobbin unit B.

In the same manner, a second open-square shaped core includes a second support part V2, a second inner protrusion part Coi2, and a second outer protrusion part Coo2. The second support part V2 has one side and the other side. The second inner protrusion part Coi2 is formed at the one side of the second support part V2 and inserted into the through hole Bi of the bobbin unit B. The second outer protrusion part Coo2 is formed at the other side of the second support part V2 along the same direction as a direction of the second inner protrusion part Coi2, and formed along one surface formed in the longitudinal direction of the bobbin unit B.

The first and second open square-shaped cores face each other and are coupled to each other. The first and second inner protrusion parts Coi1 and Coi2 form one inner core Coi. The first and second outer protrusion parts Coo1 and Coo2 and the first and second support parts V1 and V2 form one outer core Coo.

Since a description of the bobbin unit B, coil units, and terminal units is the same as that with reference to FIGS. 2A and 2B, the description thereof will be omitted.

Figure 3B:
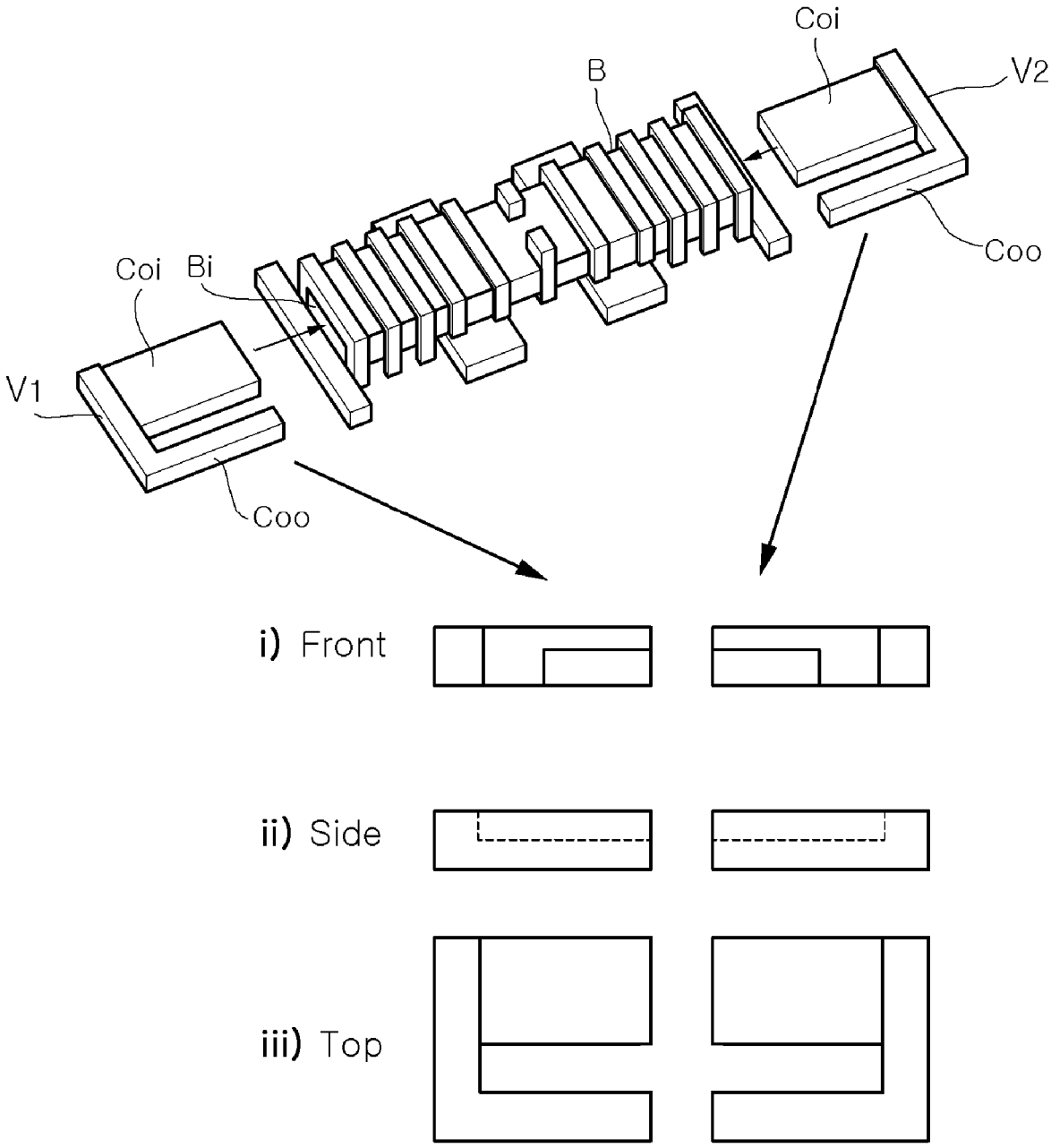
FIG. 3B is an exploded perspective view illustrating a transformer according to another exemplary embodiment of the present invention.

FIG. 3B is an exploded perspective view illustrating a transformer according to another exemplary embodiment of the present invention.

Referring to FIG. 3B, the inner protrusion parts Coi1 and Coi2 of the first and second open square-shaped cores as described above in FIG. 3A may be thinner than the outer protrusion parts Coo1 and Coo2. As the thickness of the inner protrusion parts Coi1 and Coi2 increases, the length of the bobbin unit B increases, which results in an increase in volume of the transformer. Therefore, when the thickness of the inner protrusion parts Coi1 and Coi2 is reduced within an allowable range in terms of electromagnetism, the volume of the transformer can be further reduced.

Figure 3C:
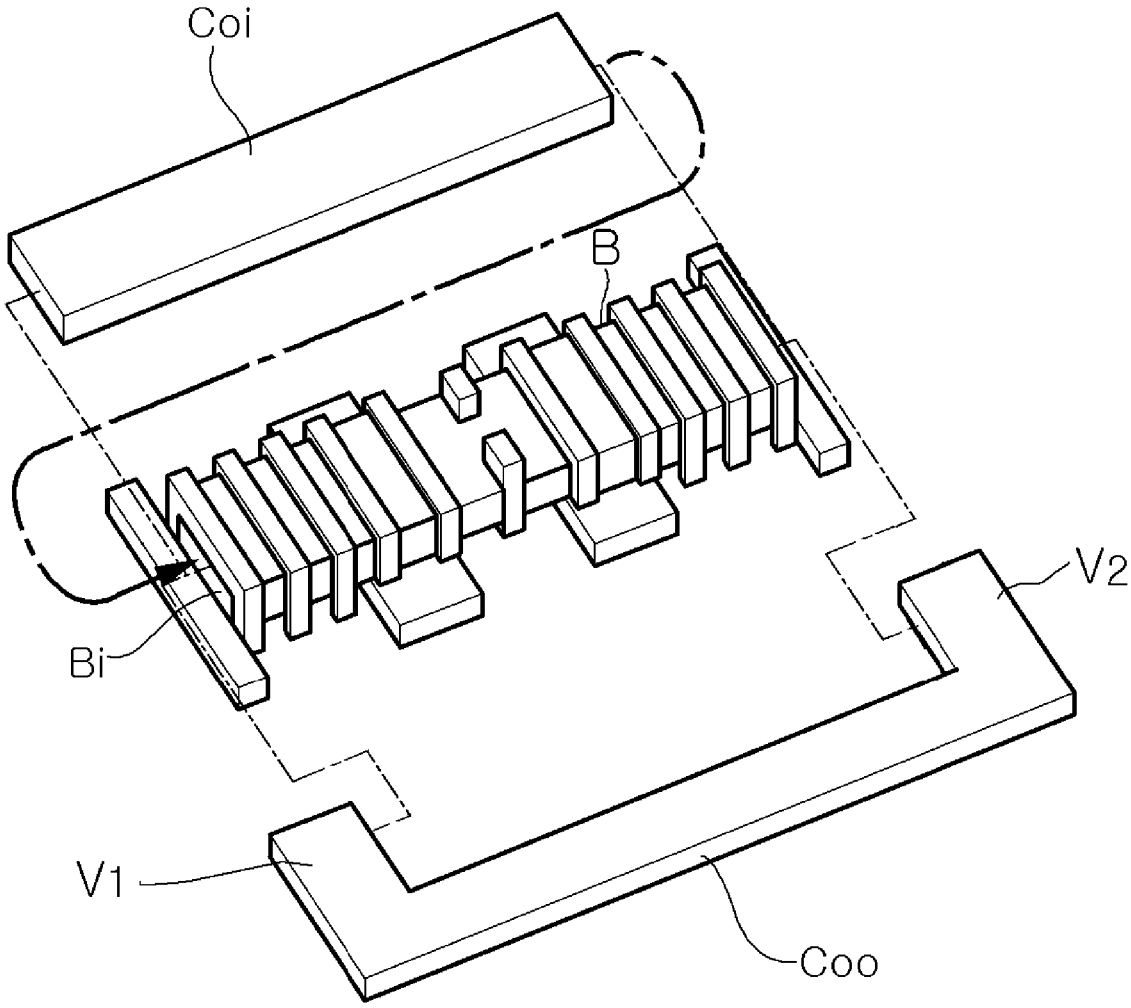
FIG. 3C is an exploded perspective view illustrating a transformer according to still another exemplary embodiment of the present invention.

FIG. 3C is an exploded perspective view illustrating a transformer according to still another exemplary embodiment of the present invention.

The still another exemplary embodiment of a core unit Co that is used in the transformer according to the invention will be described in detail.

The core unit Co includes an inner core Coi and an outer core Coo. The inner core Coi is an I-shaped core that has a predetermined length, and the outer core Coo is a C-shaped core that has a plurality of protrusion parts V1 and V2.

The inner core Coi includes one end and the other end, and is inserted into a through hole Bi of a bobbin unit B. The outer core Coo is formed along one surface in a longitudinal direction of the bobbin unit B among outer circumferential surfaces of the bobbin unit B. Further, the outer core Coo includes protrusion parts V1 and V2 that are formed at one side and the other side thereof along the same direction. The first protrusion part V1 of the outer core Coo is electrically connected to the one side of the inner core Coi, and the second protrusion part V2 is electrically connected to the other end of the inner core Coi, thereby forming one magnetic path. In the above-described core unit according to the still another embodiment of the invention, the inner core Coi is shorter than the outer core Coo. For this reason, one end surface and the other end surface of the inner core Coi are electrically connected to surfaces that face the through hole Bi of the bobbin unit B among surfaces of the first and second protrusion parts V1 and V2 of the outer core Coo.

Figure 3D:
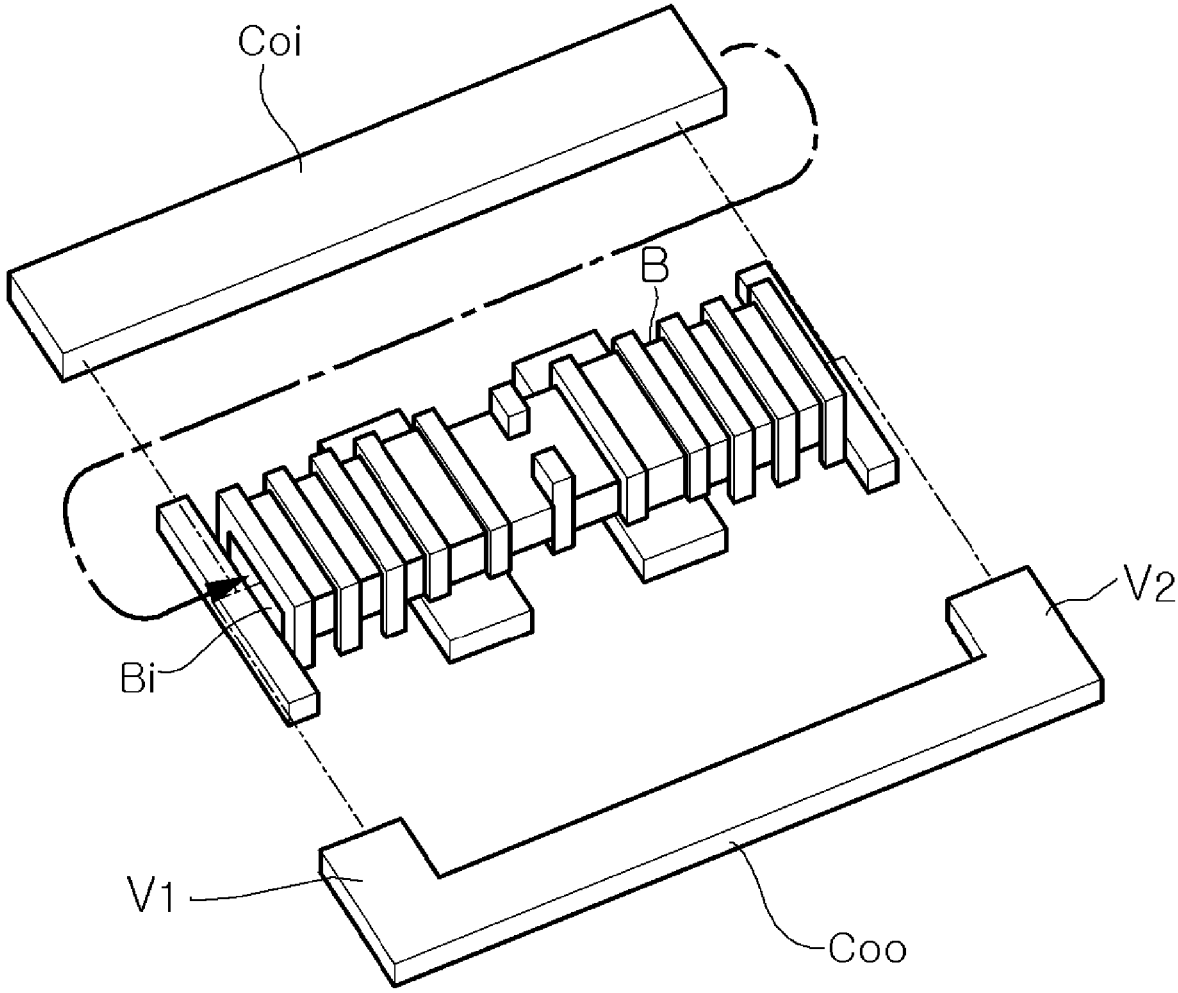
FIG. 3D is an exploded perspective view illustrating a transformer according to yet another exemplary embodiment of the present invention.

FIG. 3D is an exploded perspective view illustrating a transformer according to yet another exemplary embodiment of the present invention.

FIG. 3D illustrates the yet another exemplary embodiment of a core unit Co that is used in the transformer according to the invention when the inner core Coi and the outer core Coo of the core unit Co shown in FIG. 3C have the same length.

Referring to FIG. 3D, the inner core Coi has the same length as the outer core Coo. One side and the other side of a surface that faces the outer core Coo among surfaces of the inner core Coi are electromagnetically coupled to end surfaces of the first and second protrusion parts V1 and V2 of the outer core Coo, respectively, to thereby form one magnetic path.

Figure 4:
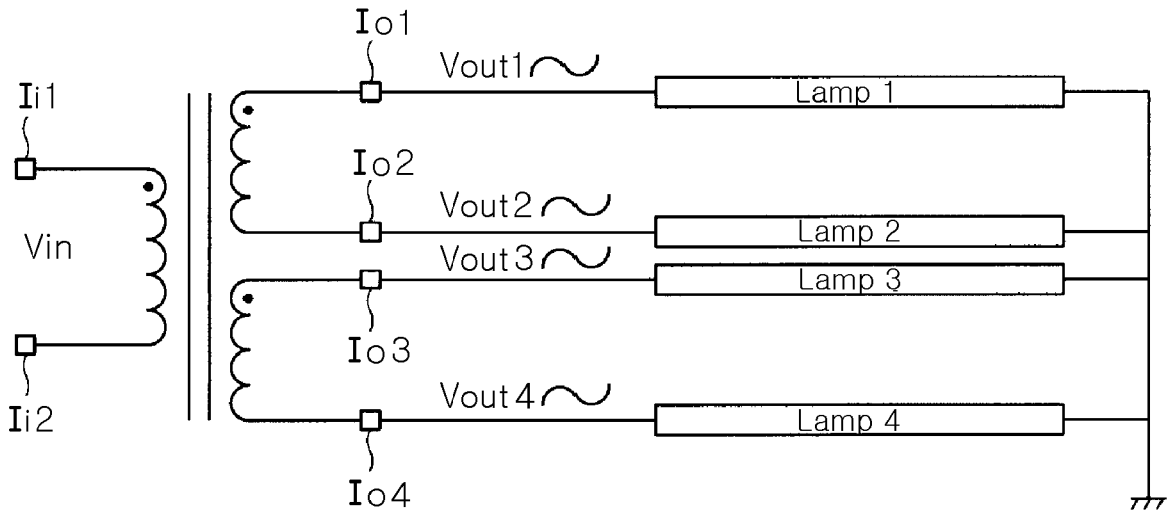
FIG. 4A is a circuit diagram illustrating one example of a connection between the transformer according to the present invention and lamps.
FIG. 4B is a circuit diagram illustrating another example of a connection between the transformer according to the present invention and lamps.
Figure 4:
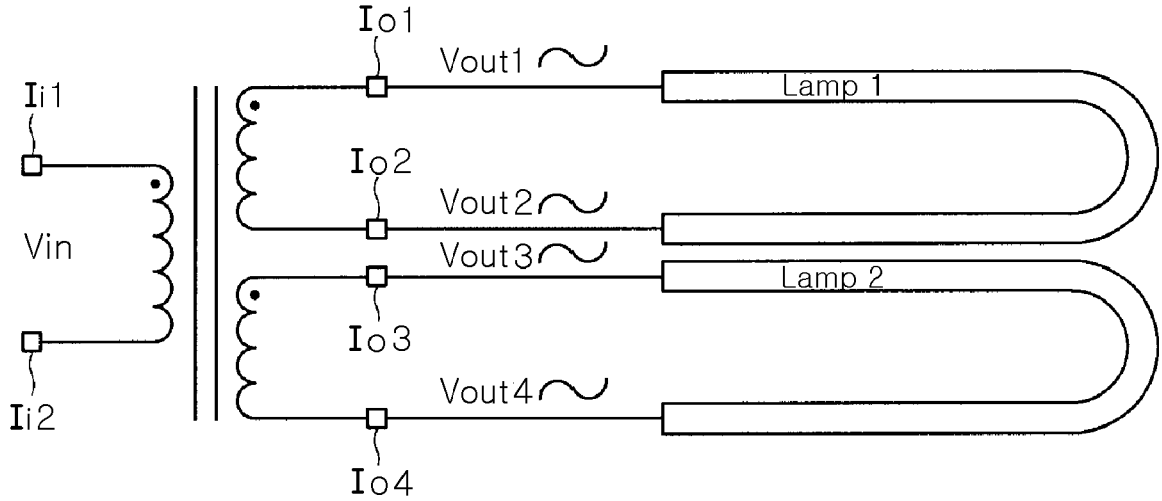

FIG. 4A is a circuit diagram illustrating one example of a connection between the transformer according to the present invention and lamps.

Referring to FIG. 4A, the transformer according to the exemplary embodiments of the present invention may be connected to a plurality of lamps. First, input power that is transmitted to the primary coil C1 through the input terminals Io1 and Io2 is converted into output power that is set beforehand according to a winding ratio between the primary coil C1 and the plurality of secondary coils C2. Then, the output power is transmitted to the plurality of lamps through the output terminals Io1, Io2, Io3, and Io4.

When each of the plurality of lamps is a long bar-shaped lamp, the four lamps receive the output power through the first to fourth output terminals Io1, Io2, Io3, and Io4. Here, the output terminals Io1 and Io2 are electrically connected to one end and the other end of one secondary coil C2, respectively, and the output terminals Io3 and Io4 are electrically connected to one end and the other end of the other secondary coil C2, respectively. Then, the four lamps emit light.

FIG. 4B is a circuit diagram illustrating another example of a connection between the transformer according to the present invention and lamps.

Referring to FIG. 4B, when each of the plurality of lamps is a U-shaped lamp, two lamps receive the output power through the first to fourth output terminals Io1, Io2, Io3, and Io4. Here, the output terminals Io1 and Io2 are electrically connected to one end and the other end of one secondary coil C2, respectively, and the output terminals Io3 and Io4 are electrically connected to one end and the other end of the other secondary coil C2, respectively. Then, the two lamps emit light. At this time, one end and the other end of one U-shaped lamp may be electrically connected to the first and second output terminals Io1 and Io2, respectively, and one end and the other end of the other U-shaped lamp may be electrically connected to the third and fourth output terminals Io3 and Io4, respectively.

Figure 5:
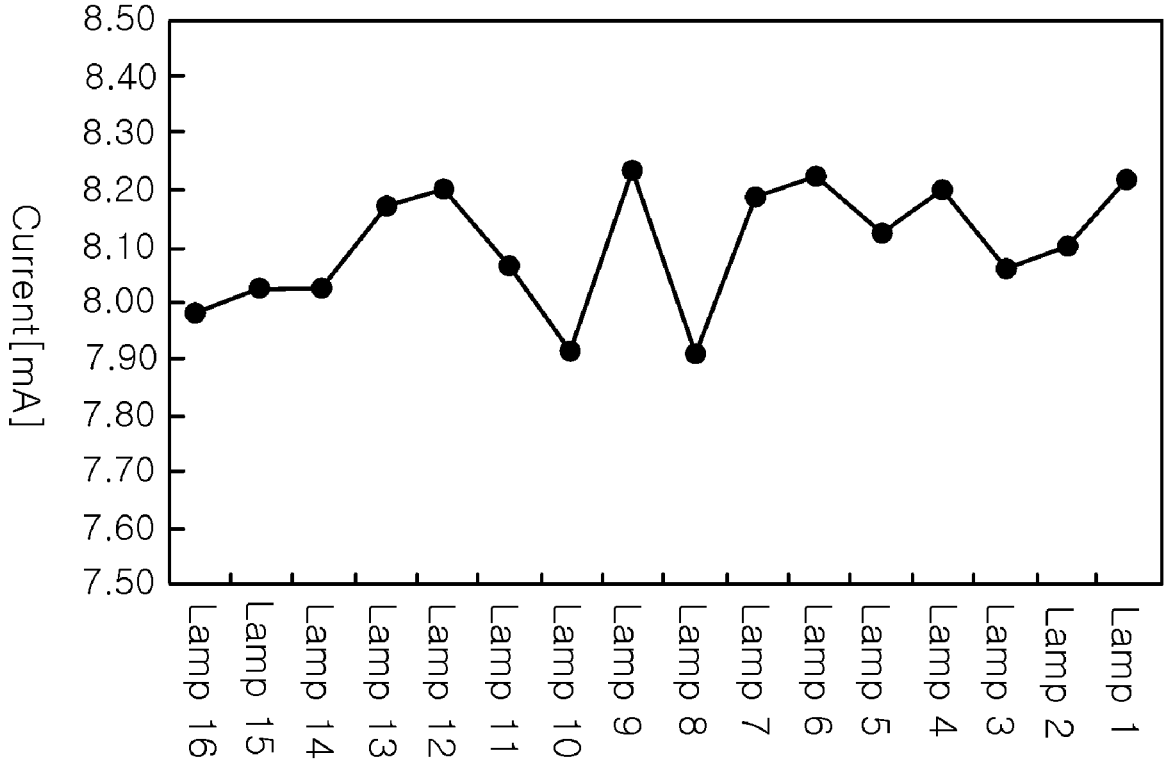
FIG. 5 is a graph illustrating a tube current of each of the lamps when the transformer according to the present invention and the lamps are connected to each other.

FIG. 5 is a graph illustrating a tube current of lamps when the transformer according to the present invention and the lamps are connected to each other.

Referring to FIG. 5, four or eight transformers according to the exemplary embodiments of the present invention are used, and lamps are connected to output terminals of the transformers. The tube current of the sixteen lamps is measured.

As shown in graph of FIG. 5, when taking into account the fact that an output current deviation that is required by a user is 0.5 mA when a rated output current (lamp tube current) is 8 mA, a deviation of the tube current that flows into the sixteen lamps is within the deviation of 0.5 mA. This means that even when the transformer according to the exemplary embodiments of the present invention has a structure in which a plurality of electric transformers are integrated into one transformer structure to form one magnetic path and reduce the volume of the transformer, the transformer accurately performs the proper function.

Figure 1:
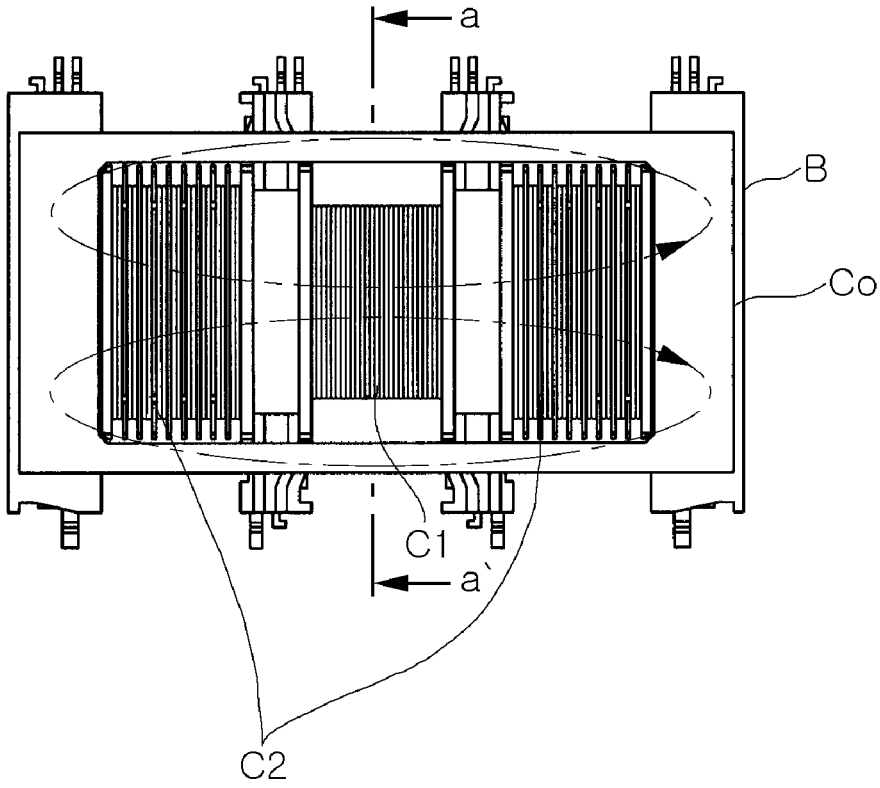
PRIOR ART FIG. 1
FIG. 1A is a plan view illustrating a transformer according to the related art.
FIG. 1B is a cross-sectional view taken along the line a-a' of the transformer according to the related art.
Figure 1:
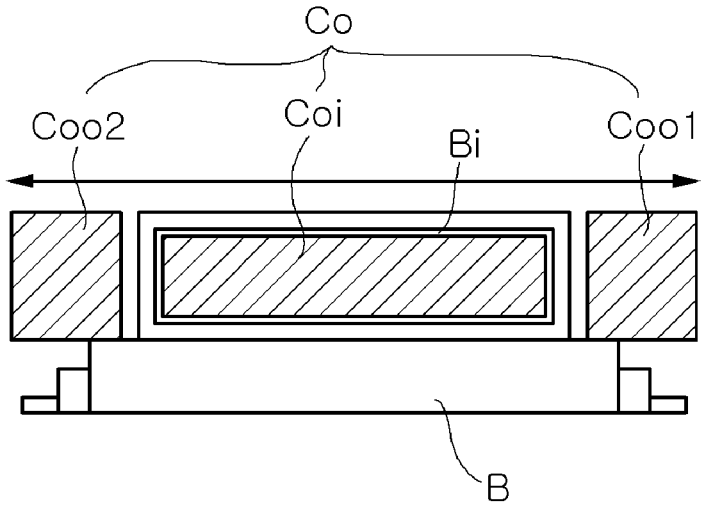
PRIOR ART FIG. 1

As described above, characteristics of the transformer according to the exemplary embodiments of the present invention are compared with those of the transformer according to the related art shown in FIGS. 1A and 1B.

TABLE 2

| Classification | Related art | Present Invention |
|---|---|---|
| Core section width Ac($mm^2$) | 43.5 | 27.0 |
| Duty ratio | 35.4 | 37.9 |
| Output current deviation(mA) | ±0.5 | ±0.5 |
| Volume($mm^3$) | 5873 | 4289 |
| Volume reduction effect (%) | | 27.0 |

Referring to Table 2, the transformer according to the related art forms two magnetic paths and a core section has a width of 43.5 $mm^2$, while the transformer according to the exemplary embodiments of the present invention forms one magnetic path and a core section has a width of 27 $mm^2$. As a result, the volume of the transformer according to the related art is 5873 $mm^3$, while the transformer according to the exemplary embodiments of the present invention is 4289 $mm^3$.

Therefore, the transformer according to the exemplary embodiments of the present invention has almost the same electrical characteristic as the transformer according to the related art. However, the volume of the transformer according to the exemplary embodiments of the present invention is reduced by approximately 27%.

As set forth above, according to exemplary embodiments of the invention, a plurality of electrical transformers are integrated into one transformer structure to form one magnetic path, thereby reducing the volume of the transformer.

While the present invention has been shown and described in connection with the exemplary embodiments, it will be apparent to those skilled in the art that modifications and variations can be made without departing from the spirit and scope of the invention as defined by the appended claims.

What is claimed is:

1. An integrated type transformer comprising:

a bobbin unit including a bobbin body having a predetermined length and a through hole therein in a longitudinal direction of the bobbin unit;

a core unit including an inner core inserted into the through hole of the bobbin unit, and an outer core positioned outside the bobbin unit and formed along one surface of the bobbin unit in the longitudinal direction thereof and electromagnetically coupled to the inner core to form a single magnetic path;

a coil unit including a primary coil wound around the outer circumferential surfaces of the bobbin unit and a plurality of secondary coils electromagnetically coupled to the primary coil; and a terminal unit including plurality of input terminals transmitting input power to the primary coil and plurality of output terminals transmitting output power from the secondary coils;

wherein the output terminals of the terminal unit are arranged at the one surface of the bobbin unit along a longitudinal direction of the bobbin unit, the output terminals being adjacent to the outer core and configured to form an electromagnetic reaction with the outer core; and wherein the input terminals of the terminal unit are formed at another surface opposite to the one surface of the bobbin unit.

2. The integrated type transformer of claim 1, wherein the inner core is an I-shaped core having one end and the other end, and the outer core is a C-shaped core having a support part formed along one surface of the bobbin unit and protrusion parts formed at one end and the other end of the support part along the same direction and electromagnetically coupled to the one end and the other end of the I-shaped core.

3. The integrated type transformer of claim 1, wherein the core unit includes two open square-shaped cores each comprising:

a support part having one end and the other end;

an inner protrusion part formed at the one side of the support part and inserted into the through hole of the bobbin unit; and an outer protrusion part formed at the other side of the support part, formed along the same direction as a direction of the inner protrusion part, and formed along one surface of the bobbin unit, and the two open square-shaped cores face each other and are electromagnetically coupled to each other, such that the inner protrusion parts of the two cores form the inner core, and the outer protrusion parts and the support parts thereof form the outer core.

4. The integrated type transformer of claim 3, wherein the thickness of the inner protrusion part is smaller than that of the outer protrusion part.

5. The integrated type transformer of claim 1, wherein the primary coil is wound around the center of the outer circumferential surfaces of the bobbin unit, and the plurality of secondary coils are wound around both sides of the circumferential surfaces around the primary coil along the longitudinal direction of the bobbin unit.

6. The integrated type transformer of claim 5, wherein a cross walk is formed at the center of the outer circumferential surfaces of the bobbin unit to equally divide the winding number of the primary coil.

7. The integrated type transformer of claim 1, wherein the output terminals are electrically coupled to a plurality of lamps, respectively.

8. An integrated type transformer, comprising:

a bobbin unit including a bobbin body having a predetermined length and a through hole formed therein in a longitudinal direction of the bobbin unit;

a core unit including an inner core inserted into the through hole of the bobbin unit, and an outer core formed outside the bobbin unit and electromagnetically coupled to the inner core to form a single magnetic path;

a coil unit including a primary coil wound around the outer circumferential surfaces of the bobbin unit and a plurality of secondary coils electromagnetically coupled to the primary coil; and a terminal unit including a plurality of input terminals configured to transmit input power to the primary coil and a plurality of output terminals configured to transmit output power from the secondary coils;

wherein the output terminals of the terminal unit are arranged at the bobbin unit, the output terminals being adjacent to the outer core along the single magnetic path and configured to generate the electromagnetic reaction with the outer core, and wherein at least two of the output terminals being arranged at the bobbin unit along the longitudinal direction thereof; and wherein the input terminals of the terminal unit are arranged to be spaced apart from the outer core in a region in which the magnetic path in the bobbin unit is absent.

* * * * *